US006246324B1

(12) United States Patent
Messenger et al.

(10) Patent No.: US 6,246,324 B1
(45) Date of Patent: Jun. 12, 2001

(54) MAINS INTERFACE MODULE

(75) Inventors: Michael Peter Messenger, Stroud; Terry Patrick O'Connell, Swindon, both of (GB)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/378,812

(22) Filed: Aug. 23, 1999

(30) Foreign Application Priority Data

Aug. 25, 1998 (EP) ..... 98306784

(51) Int. Cl.[7] ..... G08B 21/00

(52) U.S. Cl. ..... 340/540; 340/657; 340/693.7; 206/527; 206/719; 316/105; 316/818; 379/437; 379/440

(58) Field of Search ..... 340/540, 693.5, 340/657; 206/719, 527; 379/428, 437, 440, 457; 361/105, 818

(56) References Cited

U.S. PATENT DOCUMENTS 4,851,609 * 7/1989 Reddy ..... 174/35 R
4,930,047 5/1990 Peterson ..... 361/736
5,309,315 * 5/1994 Naedel et al. ..... 361/818
5,340,944 8/1994 Wang ..... 428/71
5,548,643 8/1996 Dalgleish et al. ..... 379/429
5,801,632 9/1998 Opal ..... 340/585

FOREIGN PATENT DOCUMENTS

WO 96/36093 11/1996 (WO) ..... H01R/13/74

* cited by examiner

*Primary Examiner*—Daniel J. Wu

(57) ABSTRACT

A mains interface module is disclosed for a screened enclosure containing electronic equipment. A mains interface module for a screened enclosure containing electronic equipment has a screened casing having a weather proof mains inlet connector, one or more mains outlets and contains EMI filters operative to protect the outlet(s) from interference from a mains supply when connected to the inlet connector. The screening prevents radiation of interference within the enclosure. The weatherproof mains inlet allows the equipment to be used and installed outside. The EMI filters prevent interference from being conducted through the outlets.

6 Claims, 6 Drawing Sheets

MAINS INTERFACE MODULE

CROSS-REFERENCE TO RELATED APPLICATION

This application claims priority of European Patent Application No. 983067844, which was filed on Aug. 25, 1998.

FIELD OF THE INVENTION

This invention relates to mains interface modules.

DESCRIPTION OF THE RELATED ART

Mobile cellular telecommunications base stations which operate in extremes of temeperature typically include suitable heating and/or cooling equipment. The heating and/or cooling equipment is used to maintain suitable operating temperatures for the equipment of the base station.

However, the heating and/or cooling equipment requires a power supply in order to maintain the suitable operating temperatures for the equipment of the base station. Power supplies generate electromagnetic interference (EMI). EMI can potentially disrupt the normal operation of the equipment of the base station by inducing unwanted voltages in their electronic circuits.

SUMMARY OF THE INVENTION

In accordance with the invention there is provided a mains interface module for a screened enclosure containing electronic equipment, the interface module comprising a screened casing having a weather proof mains inlet connector; one or more mains outlets and containing EMI filters operative to protect the outlet(s) from interference from a mains supply when connected to the inlet connector. The screening prevents radiation of interference within the enclosure. The weather proof mains inlet allows the equipment to be used and installed outside. The EMI filters prevent interference from being conducted through the outlets.

In one application to mobile cellular telecommunication base stations which are required to operate in extremes of temperature, it is necessary to provide heating which is controlled by a thermostat. In a preferred form the interface module includes at least two mains outlets one controlled by a thermostat internal to the interface for connection to a heater. Conventionally, a thermostat would be placed with the heater it controls.

The or each mains outlet may include a manually operated switch.

A fuse may be provided to protect all outlets.

A mains voltage detector may be provided with an indicator, responsive to the detector, to indicate presence of mains voltage.

An indicator may be provided responsive to an input from a unit powered by said interface module by which a fault diagnosed by the powered unit may be indicated.

BRIEF DESCRIPTION OF THE DRAWING

One embodiment of the invention will now be described, by way of example, with reference to the accompanying drawings, in which.

DETAILED DESCRIPTION

Figure 1:
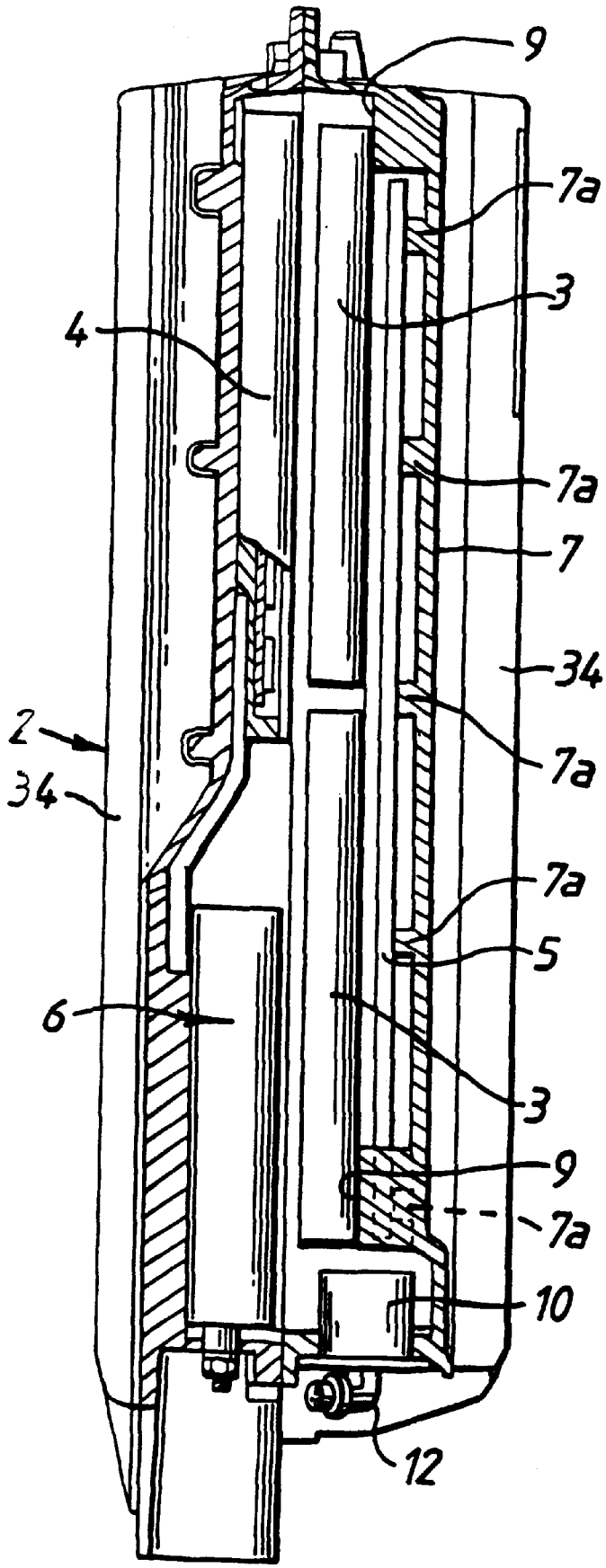
FIG. 1 is a section through base station equipment for a mobile cellular telecommunications network.
Figure 2:
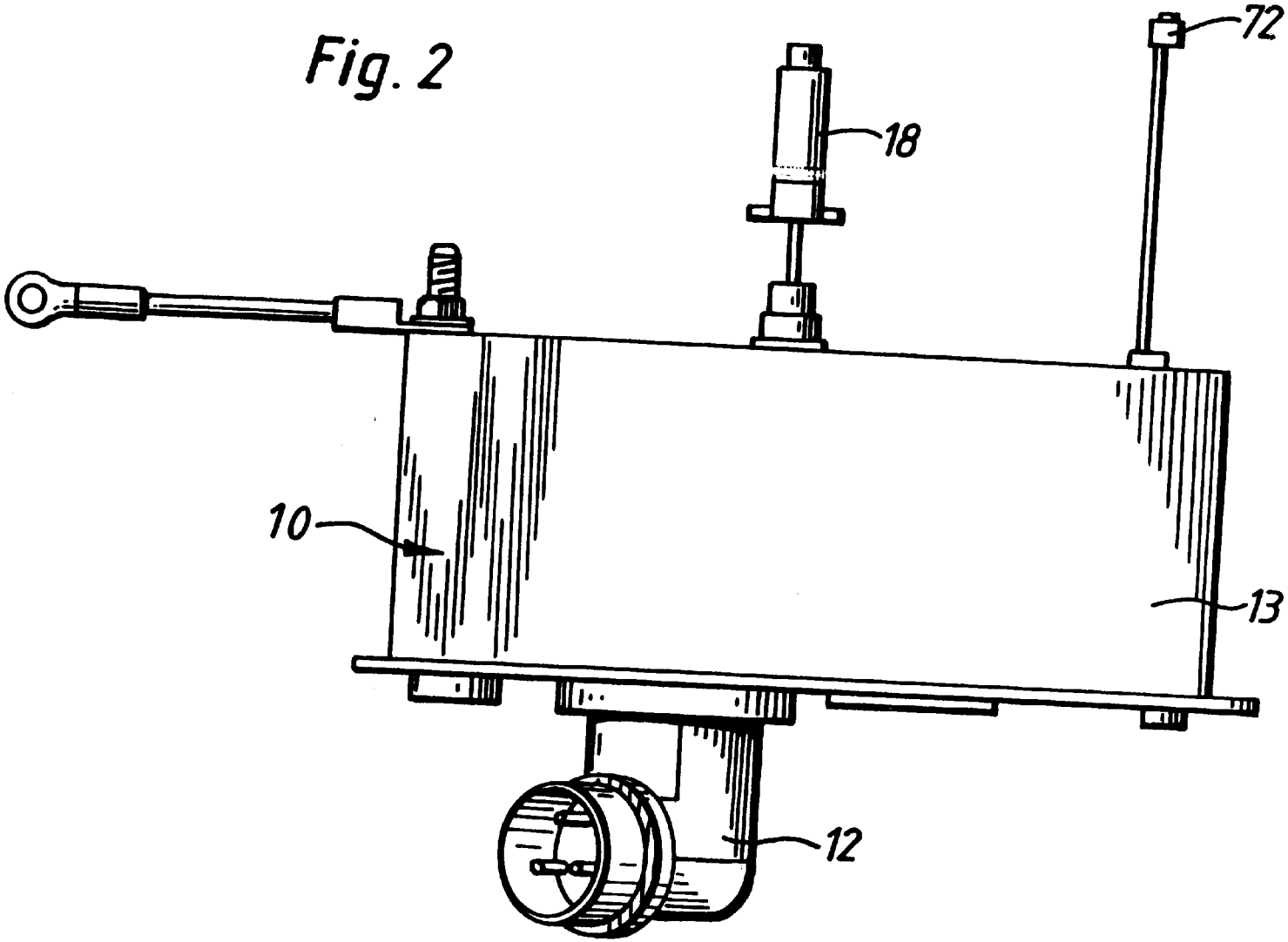
FIG. 2 is a side view of a mains interface module of the equipment of FIG. 1.

Referring to FIG. 2 the drawings, a base station for a cellular mobile telecommunications network comprises a radio unit contained by an external enclosure 2. Electronic units such as RF screened transmitter 1 receivers 3, RF screened power amplifiers 4, a processor board 5 (mounting components not shown) and duplexers 6 are environmentally sealed within the enclosure 2. The processor board 5 is mounted on protuberances 7*a* from a wall 7 of the external enclosure. The transmitter/receivers 3 are mounted by protuberances 9 over the processor board 5. Two transmitter receivers 3 are mounted side by side in the enclosure 2. Similarly, two duplexers 6 are mounted side by side so that only one is visible in FIG. 1.

In order to supply power to a power supply (not visible in FIG. 1), a mains interface module 10 has a weather proof mains inlet connector 12.

Referring to FIG. 2, the interface module 10 has a conductive housing 13 which acts as a screen against electromagnetic emissions from the unit.

Figure 3:
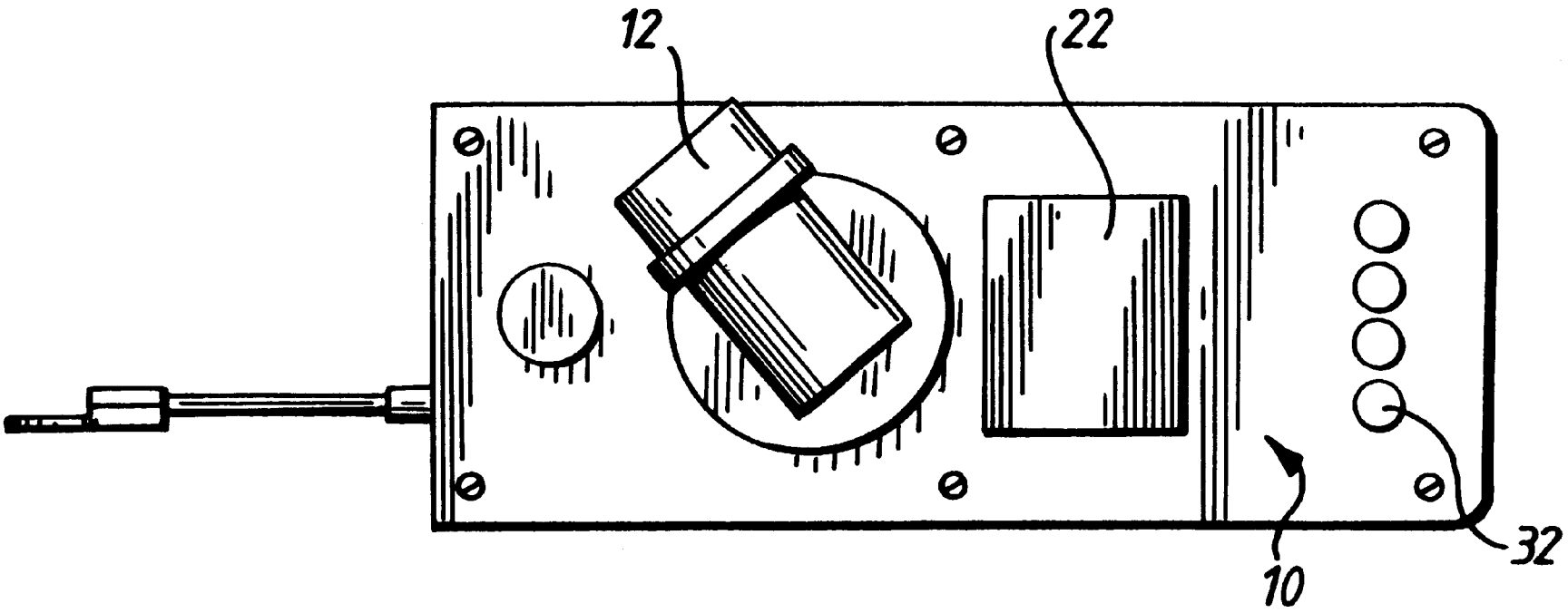
FIG. 3 is an underneath plan of the unit of FIG. 2.
Figure 5:
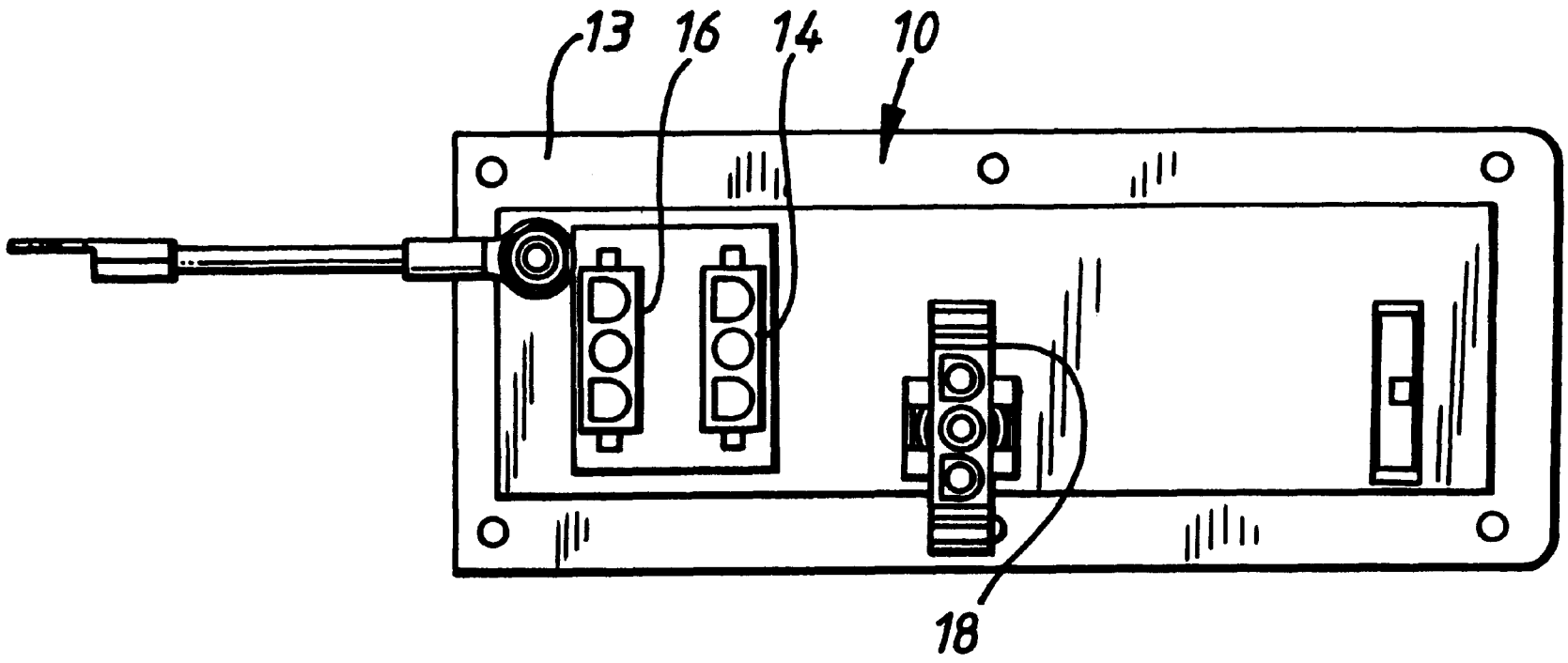
FIG. 5 is a top plan of the unit of FIG. 2.
Figure 6:
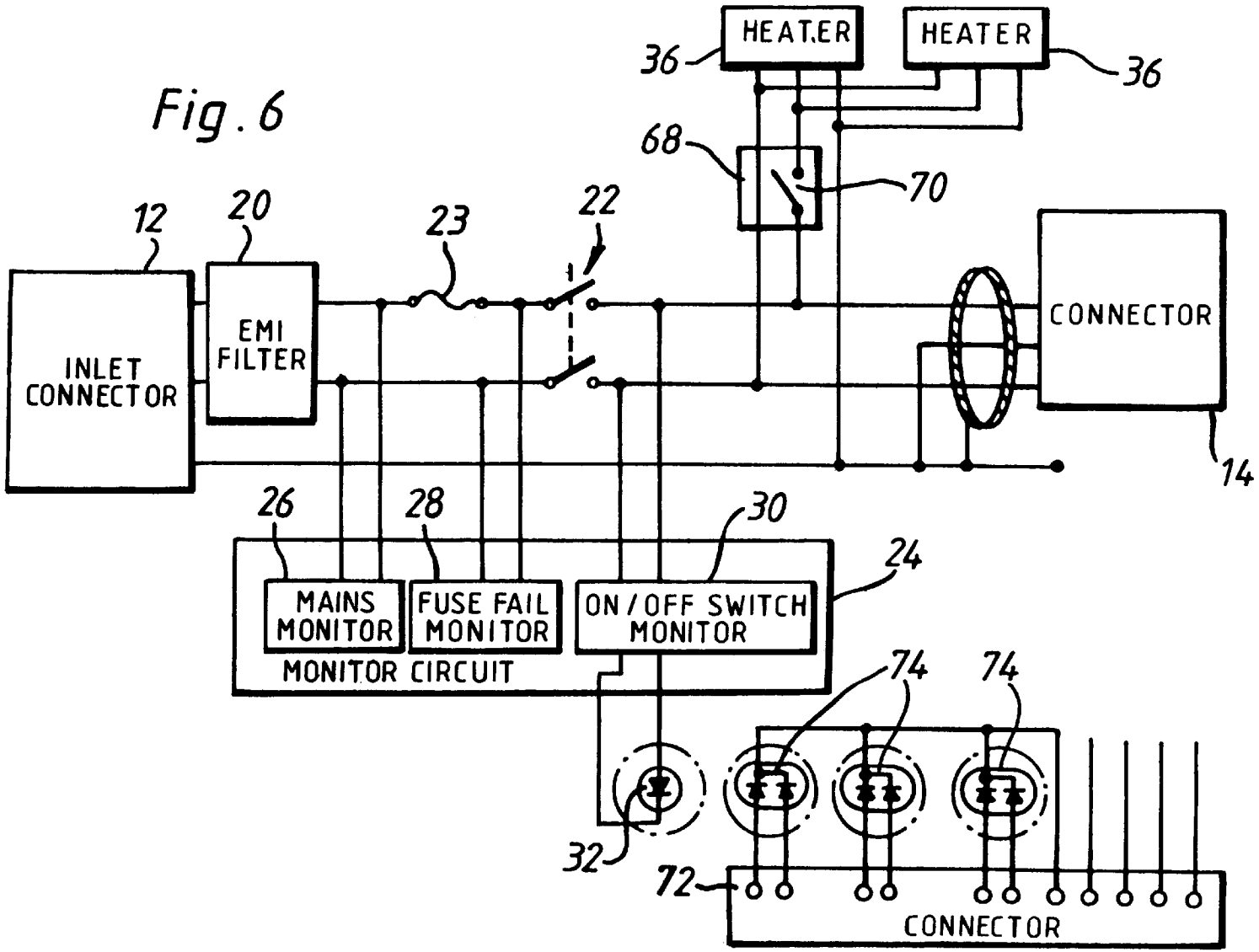
FIG. 6 is a schematic circuit diagram of the unit of FIG. 2.

The unit has three mains outlets terminated by connector sockets 14 (FIG. 5), 16 (FIG. 5) and 18 (FIGS. 2 and 5). Connectors 14 and 16 are recessed so that interference is not transmitted through the unit to the outlets, between the inlet 12 and the outlets 14, 16 and 18 is an EMI filter 20 (FIG. 6). The outlets may be isolated by a two pole on/off switch 22 (FIG. 3) and are protected by a fuse 23 (FIG.6). Referring to FIG. 6, a monitor circuit 24 contains a mains monitor 26, a fuse fail monitor 28 and an on/off switch monitor 30. The monitors have open collector outputs driving an LED indicator 32 such that the indicator shows green when all three units detect mains voltage at the appropriate points in the circuit.

The connector 14 (FIG. 5) is used to supply power to the power supply of the radio unit.

Figure 7:
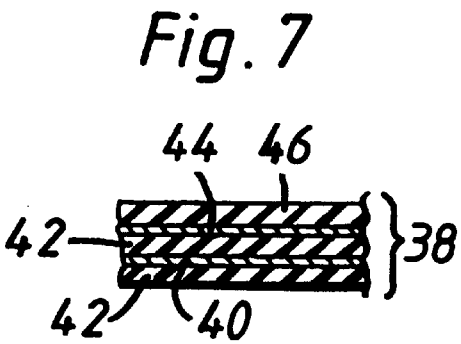
FIG. 7 is a cross section through a heater of the equipment of FIG. 1.
Figure 8:
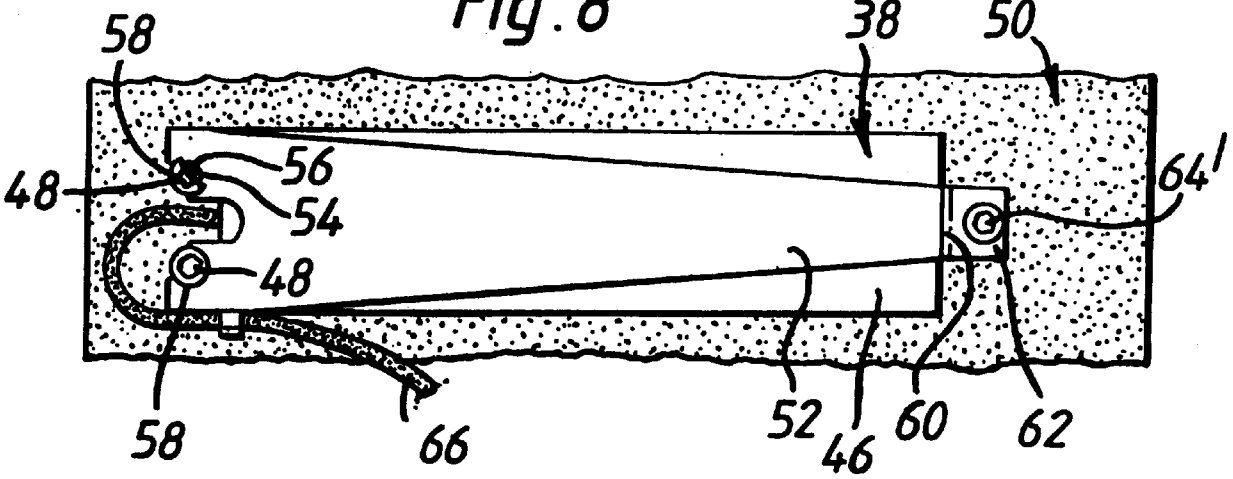
FIG. 8 is a plan view of the heater of FIG. 6.
Figure 4:
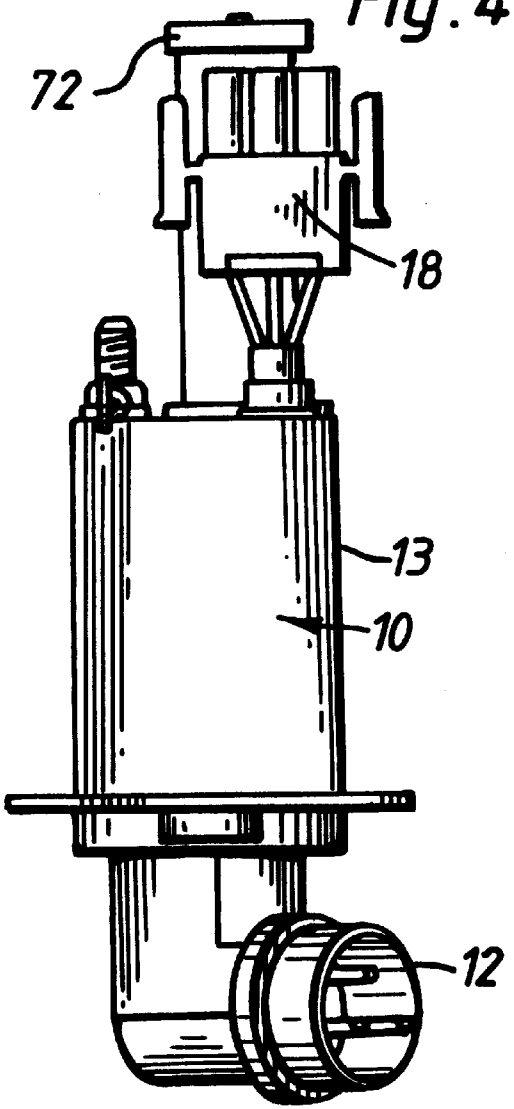
FIG. 4 is an end view of the unit of FIG. 2.

The enclosure 2 is mounted outside within an external housing (not shown). The enclosure is cooled normally by natural convection and to this end is provided with fins or extended surfaces 34 of which only two are visible in FIG. 1. In very cold environments it is possible that the internal temperature of the enclosure would become too low for the electronic units to function. In order to allow the base station to function at such low temperatures, two heaters 36 are provided, one being shown in FIGS. 7 and 8. The heater 36 has a commercially available trace heating element 38 which comprises a Nichrome foil resistor pattern 40, seen only in section in FIG. 7, sandwiched between two layers of flexible rubber dielectric 42.

The element 38 is bonded by a layer of double sided adhesive tape 44, to an aluminum sheet 46 of similar dimensions, which acts to disperse any potential hot spots in the assembled heater.

Two set screws 48, screwed into the enclosure, provide shoulders spaced a distance from the internal surface 50 of the enclosure 2. A leaf spring 52 is formed with notches 54 to receive the shanks 56 of the set screws 48 so as to be retained by the heads 58. The heads are positioned so that the underside of the spring 52 is spaced from the surface 50 of the enclosure 2 by a distance approximately equal to the combined thickness of the heating element 38 and the sheet 46.

The leaf spring 52 is curved when relaxed. At its end remote from the notches 54, the leaf spring 52 has a step providing a shoulder 60 leading to a tang 62. The step is approximately the size as the combined thickness of the heating element 38 and sheet 46. When the tang 62 is fastened to the surface 50 of the enclosure 2 by a screw 64, the leaf spring clamps the heating element with a uniform pressure against the surface 50 of the enclosure 2.

Each of the heaters has a supply lead 66 by which it is connected to a respective one of the connectors 16 or 18. As may be seen from FIG. 6, a thermostat 68 having contacts 70 is contained within the housing, to control the supply to the two heaters. When the temperature falls below a predetermined level the thermostat contacts 70 close to operate the heaters. When the temperature rises above a predetermined level, the thermostat contacts open 70 to switch off the heaters.

A connector 72 provides inputs to operate LEDs 74 and outputs for signals from and to the processor board 9. These may indicate normal operation, various start-up processes, fault conditions detected by internal diagnostic processes in the processor board and the condition of a data link to a switching center.

What is claimed is:

1. A mains interface module comprising a screened casing having a weather proof mains inlet connector; one or more mains outlets and containing EMI filters operative to protect the outlet(s) from interference from a mains supply when connected to the inlet connector.

2. The mains interface module as claimed in claim 1, including at least two mains outlets, one controlled by a thermostat internal to the interface for connection to a heater.

3. The mains interface module as claimed in claim 1 wherein each mains outlet is controlled by a manually operated switch.

4. The mains interface module as claimed in claim 1, further including a fuse to protect all outlets.

5. The mains interface module as claimed in claim 1, further including a mains voltage detector, and an indicator, responsive to the detector to indicate presence of mains voltage.

6. The mains interface as claimed in claim 1, further including an indicator responsive to an input from a unit powered by said interface module by which a fault diagnosed by the powered unit may be indicated.

* * * * *